US005223216A

United States Patent [19]

LaSalle

[11] Patent Number: 5,223,216

[45] Date of Patent: Jun. 29, 1993

[54] TOUGHNESS ENHANCEMENT OF AL-LI-CU-MG-ZR ALLOYS PRODUCED USING THE SPRAY FORMING PROCESS

[75] Inventor: Jerry C. LaSalle, Montclair, N.J.

[73] Assignee: Allied-Signal Inc., Morristownship, Morris County, N.J.

[21] Appl. No.: 856,121

[22] Filed: Mar. 27, 1992

Related U.S. Application Data

[63] Continuation-in-part of Ser. No. 681,275, Apr. 8, 1991.

[51] Int. Cl.[5] ..... C22C 21/06; C22F 1/04

[52] U.S. Cl. ..... 420/533; 148/549; 148/417; 148/439; 420/535; 420/543; 420/552

[58] Field of Search ..... 420/533, 535, 543, 552; 148/549, 439, 417

[56] References Cited

U.S. PATENT DOCUMENTS

| | | | |
|---|---|---|---|
| 4,661,172 | 4/1987 | Skinner et al. | 148/439 |
| 4,816,087 | 3/1989 | Cho | 148/439 |
| 4,995,920 | 2/1991 | Faure et al. | 148/439 |

OTHER PUBLICATIONS

Conference Proceedings of Aluminum-Lithium V, edited by T. H. Sanders and E. A. Starke, pub MCE, (1989).

Hughes et al., "Spray Deposition of Aluminum-Lithium Alloys", Proceedings of Aluminum-Lithium VI Conf., Garmisch-Partenkirchen, Oct. 1991.

*Primary Examiner*—R. Dean
*Assistant Examiner*—Robert R. Koehler
*Attorney, Agent, or Firm*—Ernest D. Buff; Gerhard H. Fuchs

[57] ABSTRACT

An Al-Li alloy consists essentially of the formula $Al_{bal}$-$Li_aCu_bMg_cZr_d$ wherein "a" ranges from about 1.9 to 3.4 wt %, "b" ranges from about 0.5 to 2.0 wt %, "c" ranges from 0.2 to 2.0 wt % and "d" ranges from about 0.3 to 1.2 wt %, the balance being aluminum. The alloy is solidified at a cooling rate of about $10^{3°}$-$10^{4°}$ C./sec by spray forming, and is characterized by a substantial absence of prior particle boundaries.

8 Claims, 6 Drawing Sheets

TOUGHNESS ENHANCEMENT OF AL-LI-CU-MG-ZR ALLOYS PRODUCED USING THE SPRAY FORMING PROCESS

CROSS-REFERENCE TO RELATED APPLICATIONS

This application is a continuation-in-part of U.S. application Ser. No. 681,275, filed Apr. 8, 1991.

1. FIELD OF THE INVENTION

This invention relates to aluminum-lithium alloy components having a combination of good fracture toughness and high tensile strength. More specifically, the invention relates to the use of a spray forming process to produce billets of Al-Li-Cu-Mg-Zr alloys having improved transverse-longitudinal, short-transverse and short-longitudinal fracture toughness.

2. BRIEF DESCRIPTION OF THE PRIOR ART

The need for structural aerospace alloys having improved specific strength and specific modulus has long been recognized. It is known that the elements lithium, beryllium, boron, and magnesium, when added to aluminum alloys, decrease their density. Current methods for production of aluminum alloys, such as direct chill (DC) continuous and semi-continuous casting have produced aluminum alloys containing up to 5 wt % magnesium or beryllium, but the alloys have generally not been adequate for widespread use in applications requiring a combination of high strength and low density. Lithium contents of about 2.5 wt % have been satisfactorily incorporated into the lithium-copper-magnesium family of aluminum alloys, such as 8090, 8091, 2090, and 2091. These alloys have copper and magnesium additions in the 1 to 3 wt % and 0.25 to 1.5 wt % range, respectively. In addition, zirconium is also added at levels up to 0.17 wt %.

The above alloys derive their good strength and toughness through the formation of several precipitate phases, which are described in detail in the Conference Proceedings of Aluminum-Lithium V, edited by T. H. Sanders and E. A. Starke, pub MCE, (1989). An important strengthening precipitate in aluminum-lithium alloys is the metastable δ' phase, which has a well defined solvus line. Thus, aluminum-lithium alloys are heat treatable, their strength increasing as precipitates nucleate from the supersaturated aluminum matrix.

The metastable δ' phase which precipitates consists of the ordered $L1_2$ crystal structure and the composition $Al_3Li$. This phase has a very small lattice misfit with the surrounding aluminum matrix, and thus has a coherent interface with the matrix. Dislocations easily shear these precipitates during deformation, resulting in the buildup of planar slip bands. This, in turn, reduces the toughness of aluminum lithium alloys. In binary aluminum-lithium alloys where this is the only strengthening phase employed, the slip planarity results in reduced toughness.

The addition of copper and magnesium to aluminum-lithium alloys has two beneficial effects. First, the elements reduce the solubility of lithium in aluminum, thus increasing the amount of strengthening δ' precipitates available. More importantly, however, the copper and magnesium allow the formation of additional precipitate phases, most importantly the orthorhombic S' phase ($Al_2CuMg$) and the hexagonal $T_1$ phase ($Al_2CuLi$). Unlike $Al_3Li$, these phases are resistant to shearing by dislocations and are effective in minimizing slip planarity. The resulting homogeneity of the deformation results in improved toughness, increasing the applicability of these alloys over binary aluminum-lithium. Unfortunately, these phases form sluggishly, precipitating primarily on heterogeneous nucleation sites such as dislocations. In order to generate these nucleation sites, the alloys must be cold worked prior to aging.

Zirconium, at levels under approximately 0.17 wt %, is typically added to the alloys to form the metastable $Al_3Zr$ phase for grain size control and to retard recrystallization. Metastable $Al_3Zr$ consists of an $L1_2$ crystal structure which is essentially isostructural with δ' ($Al_3Li$). Additions of zirconium to aluminum beyond 0.17 wt % using conventional ingot casting practices results in the formation of relatively large, deleterious dispersoids of equilibrium $Al_3Zr$ having the tetragonal $DO_{23}$ structure.

Much work has been done to develop the aforementioned alloys, which are currently near commercialization. However, the constraint imposed by the need for cold deformation prior to aging in order to develop the necessary strength has limited the application of these alloys to thin, low dimensional shapes such as sheet and plate. In addition, despite the strength gain to the cold deformation step prior to aging, the alloys still suffer from anisotrogy and low fracture toughness. Cho, U.S. Pat. No. 4,816,087, has addressed this issue by developing an elaborate thermomechanical processing sequence to ingot Al-Li alloys in which heating/deformation cycles are employed to induce recrystallized sheet having a duplex grain distribution. Such processing appears to eliminate the need for cold deformation prior to aging. However, the highly specific thermomechanical processing steps before solutionization still limit the product forms to simple shapes such as sheet and plate. Components having a complex shape such as aerospace forgings cannot be thermomechanically processed in such a manner so as to produce the desired uniform grain structure. Consequently, there are currently no conventional aluminum-lithium alloy forgings having desirable combinations of strength, ductility, and low density required in aircraft forgings.

D. J. Skinner, K. Okazaki, and C. M. Adam, U.S. Pat. No. 4,661,172 (1987) have developed a series of aluminum-lithium-zirconium alloys whereby rapid solidification by melt spinning is employed to produce powder which is consolidated to produce structural components of alloys containing lithium between 3.5 and 4.0 wt %. These alloys exhibit good strength and toughness without the need for cold work prior to aging and thus represent a significant advance compared to ingot aluminum-lithium alloys. Fracture toughness, however, is not optimal due to formation of prior particle boundaries which result during the consolidation of these powders. An additional constraint of the Skinner et al. process is the requirement that a cooling rate from the melt of greater than $10^{5°}$ C./sec be employed in producing these alloys.

Spray forming has been used to form billets composed of aluminum alloys. For instance, in U.S. Pat. No. 4,995,920 to Faure et al., billets are said to be produced by spray forming 7000 series aluminum alloys, which alloys are primarily strengthened by precipitates composed of Zn and Mg. Faure et al. were able to boost the ultimate tensile strength for alloys of the 7000 series type but were not able to reduce alloy density, a prime concern for aerospace applications. In particular, Faure et al. do not suggest that lithium, a very reactive element which has been demonstrated to lower the density of Al, should be incorporated in their spray forming process.

Hughes et. al. in "Spray Deposition of Aluminum Lithium Alloys", Proceedings of Aluminum-Lithium VI Conference, Garmisch-Partenkirchen, October, 1991, report that the Al-Li alloys 8090 and 8091, having the composition Al-2.3Li-1.1Cu-0.8Mg-0.13Zr and Al-2.5Li-1.5Cu-0.8Mg-0.10Zr, respectively, were spray formed into billets. The process is said to minimize segregation in the billet as well as formation of the deleterious $T_2$ phase. Grain size is also said to be reduced by 200 to 50 micrometers over ingot cast versions of the 8090 and 8091 alloys. Extrusion of Alloy 8090 is said to require a cold stretch after solutionization and prior to aging in order to generate adequate strength. Alloy 8091 is reported to have been forged and heat treated without cold deformation. However, the strength of that forging is low.

SUMMARY OF THE INVENTION

The present invention provides a family of aluminum-lithium-copper-magnesium-zirconium alloys having an improved combination of strength and toughness. Generally stated, the alloys consist essentially of the formula $Al_{bal}Li_aCu_bMg_cZr_d$ wherein "a" ranges from about 1.9 to 3.4 wt %, "b" ranges from about 0.5 to 2.0 wt %, "c" ranges from 0.2 to 2.0 wt % and "d" ranges from about 0.3 to 0.8 wt %, the balance being aluminum. These alloys are produced as billets by application of a spray forming process. Direct spray forming of billets from atomized powder in an inert atmosphere produces a consolidated billet in a one step process. Spray forming results in rapid solidification, that is, solidification at a cooling rate of the order of $10^3$–$10^4$ C/sec, which is sufficient to produce a supersaturated solid solution of zirconium in an aluminum matrix, allowing the effective incorporation of zirconium in increased amounts (i.e. beyond the equilibrium solubility limit of about 0.17 wt %). It has been found that in such amounts, and especially in an amount ranging from about 0.3 to 0.8 wt %, the presence of zirconium allows the formation of metastable $L1_2$ precipitates based essentially on the formula, $Al_3(Zr_xLi_{1-x})$, which confer an enhanced combination of strength and toughness in the final heat treated component. The one step production of billets through spray forming using the aluminum-lithium alloy formula defined hereinabove results in the essential elimination of prior particle boundaries and concomitant oxide contamination together with the enhanced combination of strength and toughness described previously. Elimination of the prior particle boundaries also results in improved fracture fatigue life and stress corrosion cracking resistance, particularly in the transverse-longitudinal, short-transverse and short-longitudinal orientation. The result is a light weight aluminum-lithium-zirconium alloy component having good strength and toughness in all orientations without the need for cold work prior to aging. Such a component is ideal for aerospace forging applications where a combination of low density, high modulus, and a high strength-toughness combination in all directions is desirable.

BRIEF DESCRIPTION OF THE DRAWINGS

The invention will be more fully understood and further advantages will become apparent when reference is made to the following detailed description of the preferred embodiment of the invention and the accompanying drawings, in which.

DESCRIPTION OF THE PREFERRED EMBODIMENTS

Figure 1:
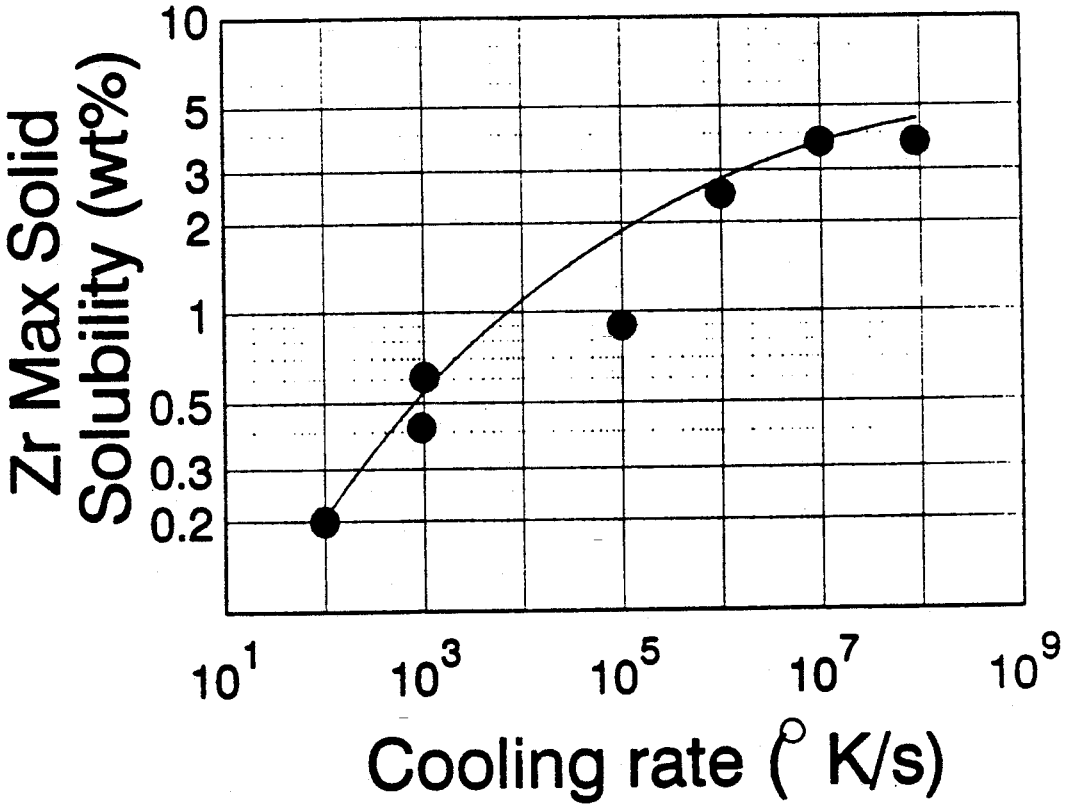
FIG. 1 is a plot of the zirconium supersaturation in a solid solution of aluminum vs. cooling rate from a molten solution.

The invention provides a family of Al-Li-Cu-Mg-Zr alloys produced by the direct one step production of billets using a spray forming process. It has been found that by spray forming these alloys there is produced an alloy having a supersaturated solid solution of zirconium in an aluminum matrix where zirconium, if present in an amount ranging from about 0.3 to 0.8 wt % causes formation of metastable $L1_2$ $Al_3(Zr_xLi_{1-x})$ precipitates which confer enhanced strength and toughness. Moreover, the direct spray forming process results in the elimination or substantial elimination of prior particle boundaries which, if present, would reduce fracture toughness. The alloys especially suited to be spray formed in accordance with the invention consist essentially of the formula $Al_{bal}Li_aCu_bMg_cZr_d$ wherein "a" ranges from about 1.9 to 3.4 wt %, "b" ranges from about 0.5 to 2.0 wt %, "c" ranges from 0.2 to 2.0 wt % and "d" ranges from about 0.3 to 1.2 wt % with the balance being aluminum. Preferably, such alloys are defined by the formula $Al_{bal}Li_eCu_fMg_gZr_h$ wherein "e" ranges from about 2.1 to 2.5 wt %, "f" ranges from about 0.8 to 1.2 wt %, "g" ranges from 0.4 to 0.6 wt % and "h" ranges from about 0.4 to 0.7 wt %, the balance being aluminum.

The benefits derived by spray forming these alloys in accordance with the invention are significant. Lithium is added to lower density, improve elastic modulus, and strengthen the alloy. Levels below about 2.5 wt % can be incorporated in ingot alloys with minimal difficulty. Higher levels, however, are not readily employed due to segregation effects. The rapid solidification cooling rate of $10^3$–$10^4$ C/sec produced during the spray forming process allows significantly higher lithium additions (i.e. as high as 3.4 wt %). Additional Li content is particularly beneficial in further lowering the density of the alloy. The copper and magnesium are added to provide solid solution strengthening and increased work hardening during deformation. In addition, these species promote the formation of the δ' ($Al_3Li$) precipitates during age hardening, providing a secondary benefit. Zirconium is added to form the metastable $L1_2$ phase consisting essentially of the formula $Al_3(Zr_xLi_{1-x})$. The $L1_2$,$Al_3(Zr_xLi_{1-x})$ precipitates appear to form during the solutionization treatment above about 440° C. employed to dissolve major Li containing phases such as δ, δ', T and/or S phases. The term "solutionization" will continue to be utilized in this document even though it is recognized that the $L1_2$, $Al_3(Zr_xLi_{1-x})$ precipitates are present during solutionization. The $L1_2$,$Al_3(Zr_xLi_{1-x})$ precipitates are isostructural with the $Al_3Li$ precipitates which form during aging of Al-Li alloys, providing additional precipitation strengthening. The $L1_2$, $Al_3(Zr_xLi_{1-x})$ precipitates, however, are more resistant to dislocation shear than $Al_3Li$ and this reduces slip planarity during deformation. This, in turn, results in an overall improvement in the strength-toughness combination and also results in improved isotropy in the mechanical properties. The $L1_2$, $Al_3(Zr_xLi_{1-x})$ also pin the grain boundaries resulting in a refined grain structure due to the prevention of grain coarsening. A refined grain structure improves strength through the well known Hall-Petch mechanism.

Due to the low solubility of zirconium in aluminum, the slow cooling inherent in ingot techniques prevents a sufficient amount of zirconium to be incorporated in solution to result in the required volume fraction of $L1_2$ , $Al_3(Zr_xLi_{1-x})$ to improve the mechanical properties. Rapid solidification has been shown to incorporate levels of zirconium in aluminum alloys to significant levels beyond the equilibrium 0.17 wt % solubility limit. As a result, rapid solidification has provided a mechanism for the formation of an enhanced volume fraction of metastable $L1_2$ precipitates of $Al_3(Zr_xLi_{1-x})$. Traditionally, once rapidly solidified particulate is produced, it is consolidated via traditional powder metallurgy techniques, for example hot pressing. However, the reactive nature of Li results in the formation of undesirable compounds on the surface of the particulate which inhibit full bonding of the powder and results in preferred crack paths. Thus, the toughness of the rapidly solidified consolidated article, while greater than ingot Al-Li alloys, is frequently below the intrinsic toughness of the alloy were the boundaries not present.

Figure 3:
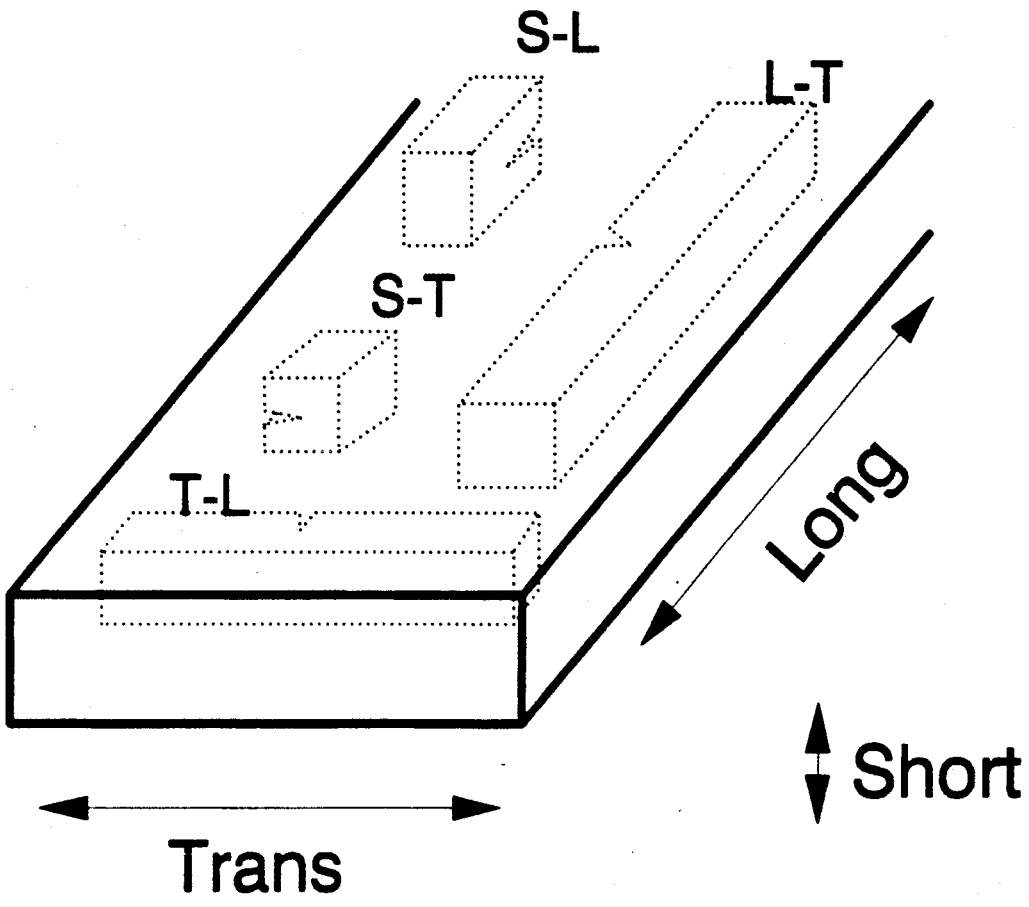
FIG. 3 is a schematic illustrating the longitudinal-transverse (L-T), Transverse-Longitudinal (T-L), Short-transverse (S-T), and Short-Longitudinal (S-L) orientations of fracture toughness specimens in an extrusion.

Unlike other powder metallurgy processes, the direct spray process results in the effective elimination of the prior particle boundaries and thus results in the elimination of convenient crack paths. Thus, the intrinsic toughness associated with the alloy matrix may be achieved rather than the toughness of the prior particle boundaries. The presence of prior particle boundaries is particularly deleterious to fracture toughness in the transverse-longitudinal (T-L), short-transverse (S-T) and short-longitudinal (S-L) orientations. These orientations are illustrated schematically by drawing FIG. 3. The elimination of the prior particle boundaries also has beneficial results on properties such as stress corrosion cracking resistance, since prior particle boundaries typically represent the weakest sites with respect to stress corrosion.

Production of billets by the spray forming process results in cooling rates below ultra rapid solidification processes, such as melt spinning, but still results in cooling rates significantly higher than ingot techniques. While the direct spray method can not incorporate the extreme supersaturation of zirconium attainable by melt spinning, it nevertheless can incorporate sufficient amounts to obtain significant improvements in the strength-toughness combination compared with ingot Al-Li alloys such as 8090.

The spray forming process is described in detail in U.S. Pat. No. 4,938,275. In the one step production of a billet using the spray forming process, a stream of liquid homogeneous metal is atomized by means of an inert gas such as nitrogen or argon. The atomizer is built to form a well defined spray of semiliquid droplets in the 30–80 micron range, which are directed on to a rotating collector plate in a pre-programmed manner. On impact, the atomized droplets are consolidated on the recipient and form a billet preform. By careful control of deposition conditions a low oxide content, macro-segregation free billet preform is made having about 97% theoretical density.

Billets produced by the spray forming process can be subject to typical forming practices for metals, such as extrusion, rolling, and forging. The alloys can also be subject to thermal processing typical of heat treatable alloys. Alloys of the composition described by this invention are typically used in the T6 temper before use, that is, the alloys are subjected to a high temperature treatment between 440° C. and 580° C. from 0.5 to 5 hours to dissolve lithium containing phases in the aluminum matrix followed by a quench in a fluid bath to retain the lithium in solution. Subsequently the alloys of the invention are aged from between 100° C. to 200° C. from 0.5 to 100 hrs to precipitate strengthening phases.

Wrought products subjected to treatment as described above and aged to about their peak strength have a tensile yield strength ranging from about 345 to 545 MPa and preferably from about 400 to 450 MPa, an ultimate tensile strength from about 480 to 570 MPa and preferably about 510 to 540 MPa, with an elongation to fracture ranging from about 4 to 9% and preferably about 5 to 7% when measured at room temperature (20° C.). The notched impact energy of these alloys ranges from about $2.6\times10^{-2}$ to $1.1\times10^{-1}$ Joule/mm$^2$ and preferably about $3.5\times10^{-2}$ to $7.8\times10^{-2}$ Joule/mm$^2$, in the T-L orientation and $7.0\times10^{-2}$ to $2.1\times10^{-1}$ Joule/mm$^2$, preferably $1.2\times10^{-1}$ to $1.7\times10^{-1}$ Joule/mm$^2$, in the L-T orientation. In addition, the density of these alloys is less than 2.60 g/cm$^3$, and preferably ranges from about 2.53 to 2.56 g/cm$^3$.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

The effect of cooling rate from the molten state on zirconium supersaturation in an aluminum matrix is shown in FIG. 1. The data used in the plot was taken from L. M. Burov and A. A. Yankin, Russ J. Phys. Chem., 1968, 42(4),540–541 and R. Ichikawa, T. Omashi, and T. Ikeda, Trans. Jap. Inst. Met.,12,2-

80–284(1971). The cooling rates employed in the plot cover a variety of processing techniques with ingot solidification occurring at rates below about $10^{2}$° C./sec, atomizing techniques of between $10^{3}$ ° and $10^{4}$° C./sec, and melt spinning techniques between $10^{5}$ ° and $10^{6}$° C./sec. The plot reveals that approximately 0.6 wt % Zr can be supersaturated using the atomizing technique.

EXAMPLE 2

The mechanical properties of a 1.0×5.5 cm extrusion from melt spun Al-2.1Li-1.0Cu-0.5Mg-0.6Zr are listed in Table I. The extrusion is made from a compacted billet extruded with a 18:1 reduction ratio. Final heat treatment of the extrusion consists of a 490° C. 2 hour solutionization, water quench, and a 48 hour age at 148° C. The extrusion has a good combination of strength and toughness, without being cold stretched prior to aging, due to the presence of a significant volume fraction of $L1_2,Al_3(Zr_xLi_{1-x})$. However, the T-L and L-T fracture toughness values are not optimized due to the presence of prior particle boundaries which are decorated with oxide contaminants. Elimination of the oxide at the boundaries would increase the fracture toughness.

TABLE I

| Orientation | Yield (MPa) | Ult (MPa) | El (%) | $K_{IC}$ (MPa√m) |
|---|---|---|---|---|
| L-T | 430 | 520 | 6 | 25 |
| T-L | 430 | 510 | 5 | 17 |

EXAMPLE 3

The mechanical properties of a 1.0×5.5 cm extrusion of Al-2.1Li-1.0Cu-0.5Mg-0.6Zr made via the spray forming process are listed in Table II. The extrusion is made from a compacted billet extruded with a 18:1 reduction ratio. Final heat treatment of the extrusion consists of a 490° C. 2 hour solutionization, water quench, and a 48 hour age at 148° C. The extrusion has a good combination of strength and toughness, without being cold stretched prior to aging, due to the presence of a significant volume fraction of $L1_2,Al_3(Zr_xLi_{1-x})$. In this extrusion, made from a spray formed billet, the prior particle boundaries are absent, dramatically increasing the toughness. The T-L and L-T toughnesses of the extrusion from the spray formed billet are approximately 80% greater than the respective toughnesses of the billet made from the consolidated melt spun powder, which is otherwise processed identically.

TABLE II

| Orientation | Yield (MPa) | Ult (MPa) | El (%) | $K_{IC}$ (MPa√m) |
|---|---|---|---|---|
| L-T | 440 | 510 | 7 | 45 |
| T-L | 410 | 490 | 9 | 30 |

EXAMPLE 4

Figure 2A:
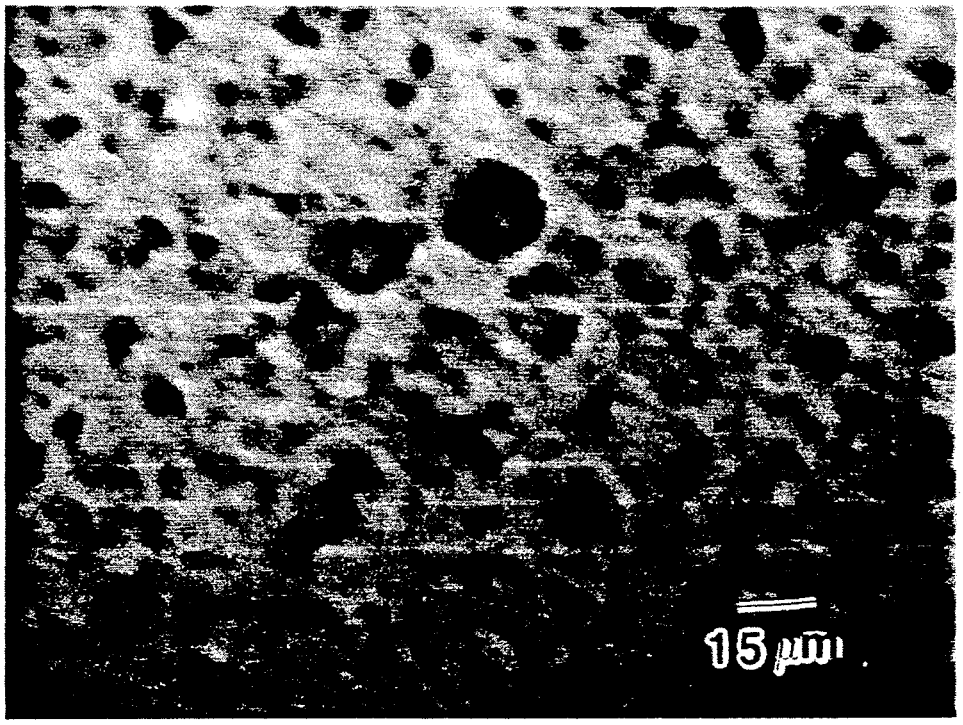
FIG. 2*a* is a bright field TEM micrograph of a spray formed billet having the composition Al-2.1Li-1.0Cu-0.4Mg-0.6Zr which was solutionized at 490° C. for 2 hours, water quenched, and aged at 148° C. for 100 hours.
Figure 2B:
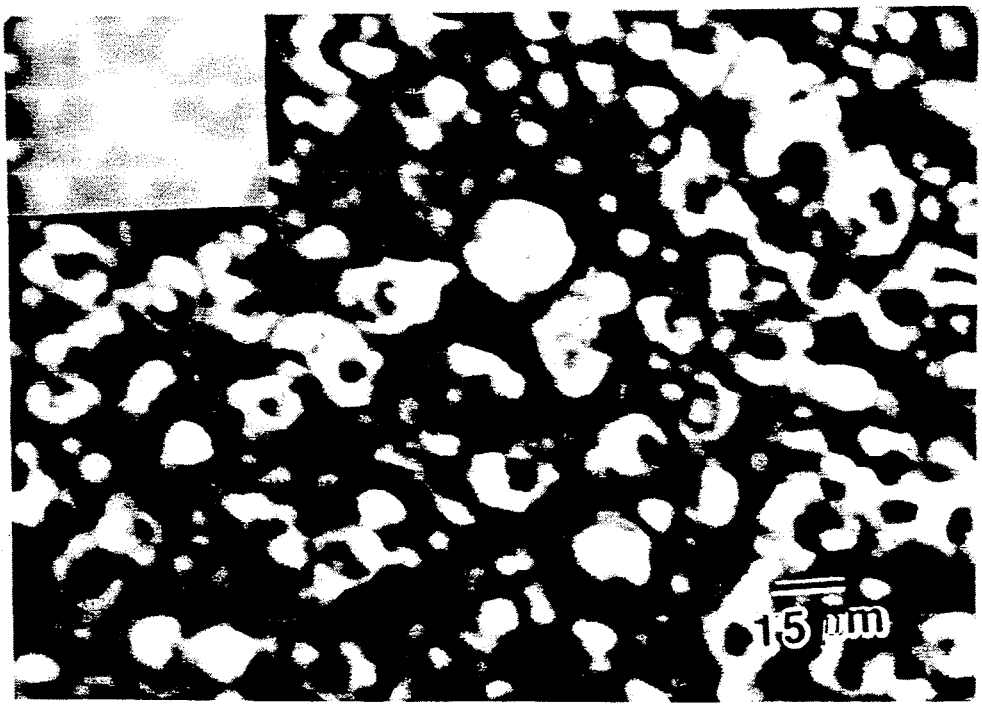
FIG. 2*b* is a 100 superlattice dark field image of FIG. 2*a;*

This example illustrates the presence of a large volume fraction of $L1_2,Al_3(Zr_xLi_{1-x})$ in a spray formed billet having the composition Al-2.1Li-1.0Cu-0.4Mg0.6Zr which was solutionized at 490° C. for 2 hours, water quenched and aged at 148° C. for 100 hours. FIGS. 2a and 2b are bright field and 100 superlattice dark field transmission electron micrographs clearly showing the $L1_2,Al_3(Zr_xLi_{1-x})$ precipitates, imaged in the dark field micrographs as 20 nanometer kernels surrounded by the brightly imaged δ' precipitates. The $L1_2,Al_3(Zr_xLi_{1-x})$ forms during the solutionization of major Li containing phases such as δ and δ' during the 490° C.+water quench treatment. The brightly imaging δ' nucleates and grows around the $L1_2,Al_3(Zr_xLi_{1-x})$ during the aging at 148° C.

EXAMPLE 5

Figure 4:
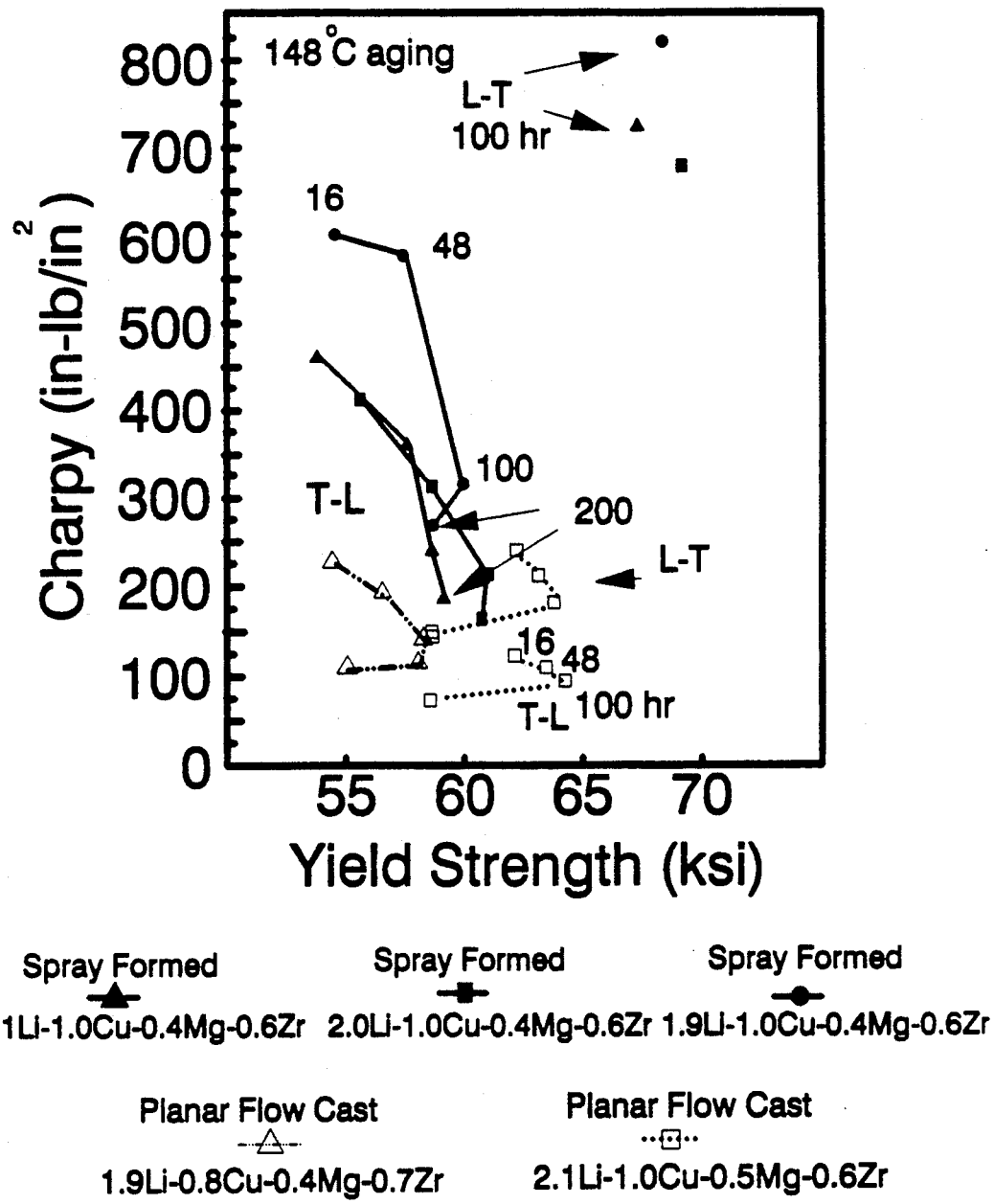
FIG. 4 is a graph plotting the strength-toughness combination of Al-Li alloys made from either melt spun and compacted particulate or spray deposited billets wherein properties are improved along a diagonal away from the origin.

Extrusions made from spray formed billets having the compositions listed in Table III were subjected to thermal treatments consisting of a 490° C., 2 hour solutionization, water quench, and aging at 148° C. for the times depicted by FIG. 4. Notched impact specimens having a notch radius of 0.025 mm were made from the extrusion. The strength toughness combination of each of these extrusions is graphically compared with that of the extrusion of Example 2 (made from a melt spun Al-2.1Li-1.0Cu-0.5Mg-0.6Zr alloy) and an additional extrusion made identically as in Example 2 having the composition Al-1.9Li-0.8Cu-0.4Mg-0.7Zr in FIG. 4. Properties are improved along a diagonal away from the origin. The plot of FIG. 4 indicates that the combination of strength-toughness values possessed by the extrusion made from the spray formed billet is superior to that of the extrusion made from the melt spun material. The extrusions have a good combination of strength and toughness, without being cold stretched prior to aging, due to the presence of a significant volume fraction of $L1_2,Al_3(Zr_xLi_{1-x})$ precipitates present after the 490° C. solutionization and water quench.

TABLE III

| |
|---|
| Al—2.0Li—1.0Cu—0.4Mg—0.6Zr |
| Al—1.9Li—1.0Cu—0.4Mg—0.6Zr |

EXAMPLE 6

Figure 5A:
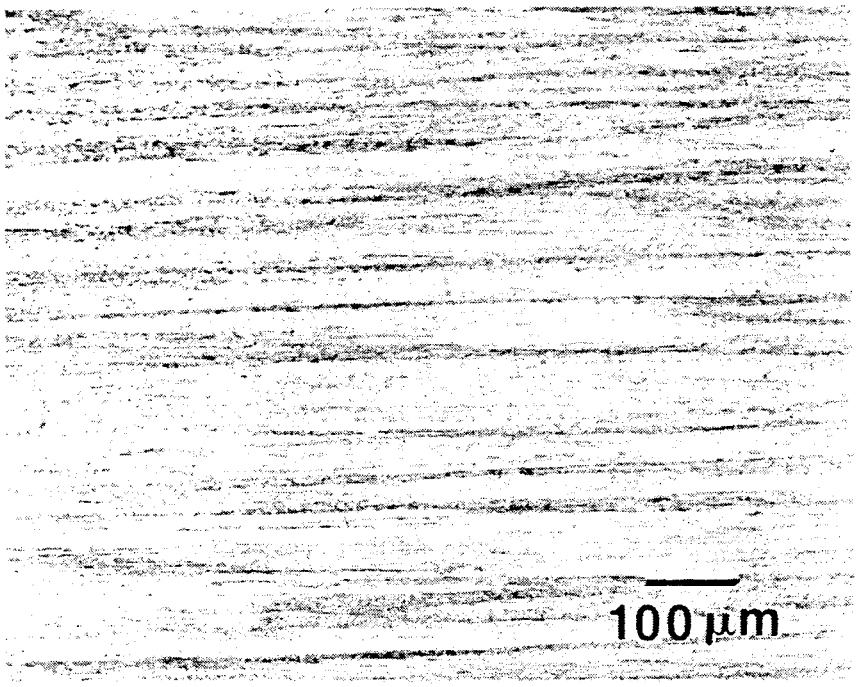
FIG. 5*a* is a micrograph showing the prior particle boundaries, decorated by oxides, of an extrusion made from rapidly solidified Al-Li ribbon.
Figure 5B:
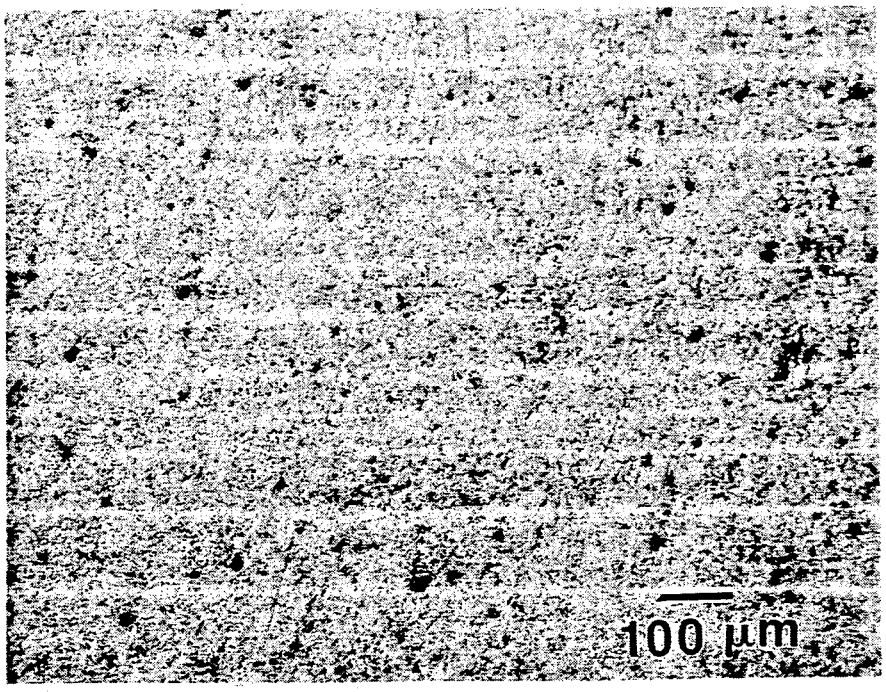
FIG. 5*b* is a micrograph characterized by the absence of prior particle boundaries of an extrusion made from spray deposited Al-Li.

This example illustrates the effective elimination of prior particle boundaries in the spray deposited material. FIG. 5a shows an optical micrograph of the melt spun and compacted rectangular bar extruded as described in Example 2. The prior particle boundaries are clearly delineated by oxide particles which provide a convenient crack path, lowering fracture toughness. FIG. 5b shows a similar optical micrograph of a rectangular bar made from a spray formed billet extruded as described in Example 3. As illustrated by FIG. 5b, the prior particle boundaries are absent, increasing fracture toughness, since there no longer exists a preferred crack path. In addition, properties such as resistance to stress corrosion cracking and fatigue life are also improved in the spray formed material compared to the melt spun and compacted material due to the elimination of the prior particle boundaries.

EXAMPLE 7

Figure 6A:
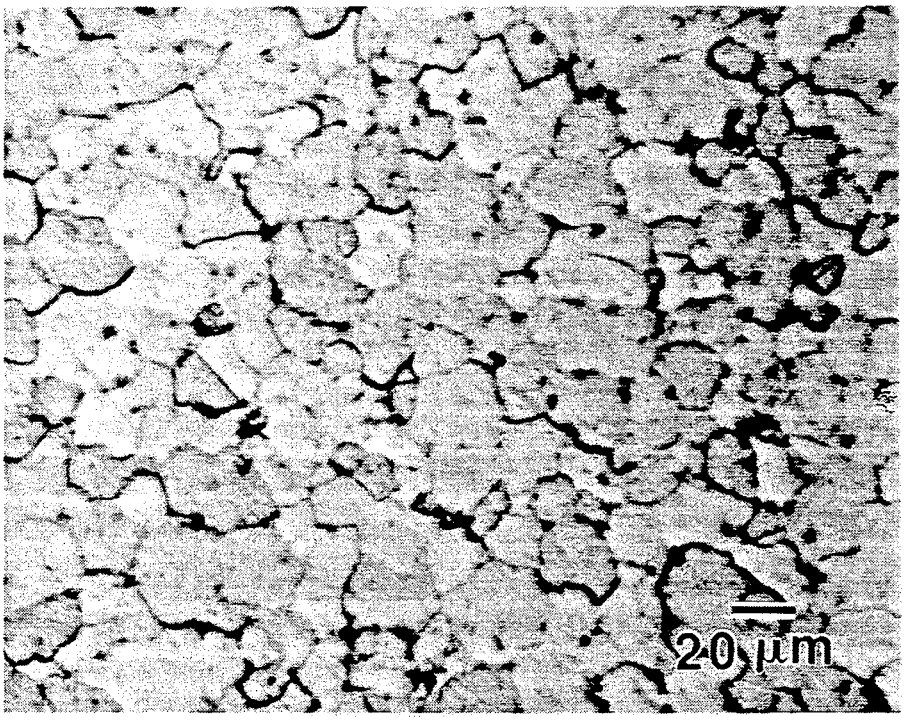
FIG. 6*a* shows an optical micrograph of spray formed billet after solutionization having the composition Al-2.1Li-1.0Cu-0.4Mg-0.6Zr.
Figure 6B:
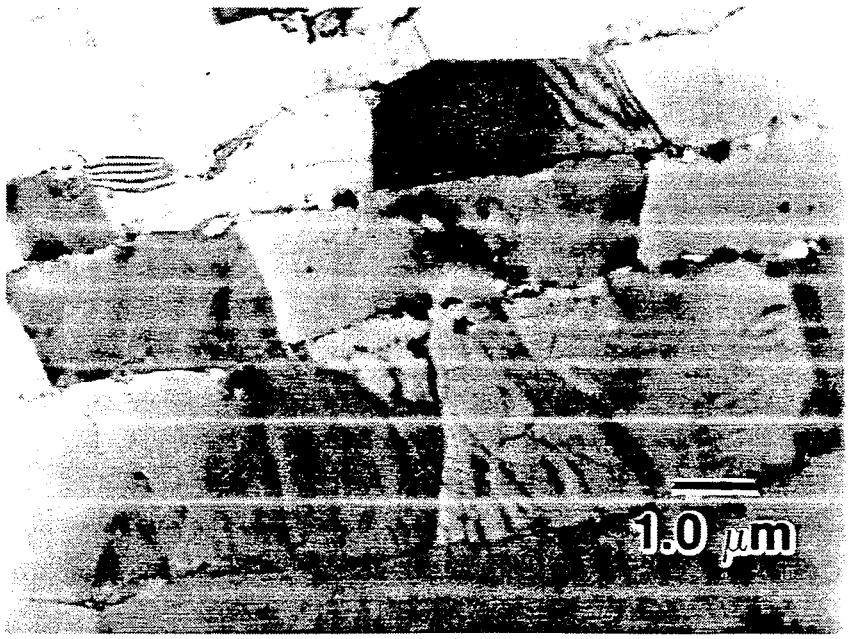
FIG. 6*b* shows a transmission electron micrograph of the same spray formed billet as in 5*a* after extrusion and solutionization.

This example shows the beneficial effect of a hot working step in reducing the grain size of the Spray formed billet of an Al-Li alloy having zirconium concentrations in excess of the solubility limit of about 0.17% (wt). Refined grain size in turn leads to improved mechanical properties via the well known Hall-Petch relation. FIG. 6a is an optical micrograph of a spray formed billet of Al-2.1Li-1.0Cu-0.4Mg-0.6Zr after solutionization. A 50 micrometer grain size is clearly observed. FIG. 6b is a TEM micrograph of an extruded bar made from that same billet which was solutionized after extrusion. It is clear that the grains are refined and stable having a grain size of approximately 5 micrometers. The refined, stable grain size is due to the presence of a high volume fraction of $L1_2$,$Al_3(Zr_xLi_{1-x})$, precipitates, which is achieved as the direct result of the high Zr levels of these alloys. Hughes et. al. report a 50 micrometer grain size in extrusions made from spray formed 8090, which alloy has a zirconium content of only 0.17%.

EXAMPLE 8

This example illustrates the beneficial effect on mechanical properties of additional zirconium made possible via rapid solidification using the spray forming process. Table IV lists the tensile properties of alloys 8090 and 8091, reported by the Hughes et al. publication, and the spray formed alloy Al-2.1Li-1.0Cu-0.4Mg-0.6Zr. It should be emphasized that the alloy 8090 was cold stretched prior to aging to provide enhanced strength, whereas the spray formed Al-2.1Li-1.0Cu-0.4Mg-0.6Zr alloy was not cold stretched. The spray formed Al-2.1Li-1.0Cu-0.4Mg-0.6Zr alloy exceeded the strength of the 8090 alloy while providing greater elongation. The spray formed Al-2.1Li-1.0Cu-0.4Mg-0.6Zr alloy also evidenced an improved combination of strength and elongation compared to alloy 8091, despite the fact that alloy 8091 has considerably more Li, Cu, and Mg, which were added to boost the strength of that alloy. Also included for reference are values of ingot processed 8090 taken from Table 3.013 of the "Structural Alloys Handbook", Batelle, Columbus Laboratory.

TABLE IV

| | Dir | YS (MPa) | UTS (MPa) | El (%) | $K_{IC}$ (MPa$\sqrt{m}$) |
|---|---|---|---|---|---|
| Spray formed 8090 Al—2.3Li—1.1Cu—0.8Mg—0.13Zr (cold stretched) peak aged | T | 390 | 489 | 8.5 | 17.4 |
| Spray formed 8091 Al—2.5Li—1.5Cu—0.8Mg—0.10Zr | T | 368 | 502 | 7.2 | — |
| Al—2.1Li—1.0Cu—0.4Mg—0.6Zr aged 148° C.-48 hrs. | T | 410 | 490 | 9.0 | 30 |
| INGOT 8090-T8251 (Extrusion) | T | 380 | 450 | 4 | 20 |

Having thus described the invention in rather full detail, it will be understood that these details need not be strictly adhered to but that various changes and modifications may suggest themselves to one skilled in the art, all falling within the scope of the invention as defined by the subjoined claims.

What is claimed is:

1. An al-Li alloy consisting essentially of the formula $Al_{bal}Li_aCu_bMg_cZr_d$ wherein "a" ranges from about 1.9 to 3.4 wt %, "b" ranges from about 0.5 to 2.0 wt %, "c" ranges from 0.2 to 2.0 wt % and "d" ranges from about 0.3 to 0.8 wt %, the balance being aluminum, said alloy having been solidified at a cooling rate of about $10^{3°}$ to $10^{4°}$ C./sec by spray forming and being characterized by a substantial absence of prior particle boundaries.

2. An al-Li alloy consisting essentially of the formula $Al_{bal}Li_aCu_bMg_cZr_d$ wherein "a" ranges from 2.1 to 2.5 wt %, "b" ranges from about 0.8 to 1.2 wt %, "c" ranges from 0.4 to 0.6 wt % and "d" ranges from about 0.4 to 0.7 wt %, the balance being aluminum, said alloy having been solidified at a cooling rate of about $10^{3°}$ to $10^{4°}$ C./sec by spray forming and being characterized by a substantial absence of prior particle boundaries.

3. A component formed from a billet spray deposited at a cooling rate of about $10^{3°}$–$10^{4°}$ C./sec and consisting essentially of an alloy having the formula $Al_{bal}Li_aCu_bMg_cZr_d$ wherein "a" ranges from about 1.9 to 3.4 wt %, "b" ranges from about 0.5 to 2.0 wt %, "c" ranges from 0.2 to 2.0 wt % and "d" ranges from about 0.3 to 0.8 wt %, the balance being aluminum, said alloy being characterized by a substantial absence of prior particle boundaries.

4. A component as recited by claim 3, wherein said alloy has the composition 2.1 wt % lithium, 1.0 wt % copper, 0.5 wt % magnesium and 0.6 wt % zirconium, the balance being aluminum.

5. A component as recited by claim 3, having a 0.2% tensile yield strength of 380 MPa, ultimate tensile strength of 480 MPa, elongation to fracture of 7%, and transverse-longitudinal impact energy in excess of $5.2\times10^{-2}$ J/mm$^2$.

6. A component as recited by claim 3, having a tensile yield strength ranging from about 345 to 545 MPa, an ultimate tensile strength ranging from about 480 to 570 MPa, an elongation to fracture ranging from about 4 to 9%, a T-L notched impact energy ranging from about $2.6\times10^{-2}$ to $1.1\times10^{-1}$ Joule/mm$^2$ and a L-T notched impact energy ranging from about $7.0\times10^{-2}$ to $2.1\times10^{-1}$ Joule/mm$^2$.

7. An alloy as recited by claim 1, said alloy having a density of less than about 2.6 g/cm$^3$.

8. An alloy as recited by claim 2, said alloy having a density of about 2.55 g/cm$^3$.

* * * * *